US009887509B2

(12) United States Patent
Vladimiro

(10) Patent No.: US 9,887,509 B2
(45) Date of Patent: Feb. 6, 2018

(54) AUTOMATED SYSTEM FOR THE REALISATION OF THE INDUSTRIAL WIRING OF IDC CONNECTORS

(71) Applicant: KM Corporate s.r.l., San Giorgio delle Pertiche (IT)

(72) Inventor: Carlotto Vladimiro, San Giorgio delle Pertiche (IT)

(73) Assignee: KM CORPORATE S.R.L., San Giorgio delle Pertiche (IT)

( * ) Notice: Subject to any disclaimer, the term of this patent is extended or adjusted under 35 U.S.C. 154(b) by 0 days.

(21) Appl. No.: 15/442,357

(22) Filed: Feb. 24, 2017

(65) Prior Publication Data

US 2017/0237218 A1 Aug. 17, 2017

(30) Foreign Application Priority Data

Feb. 16, 2016 (IT) ..... UB2016A1115

(51) Int. Cl.
*H01R 43/16* (2006.01)
*H01R 4/14* (2006.01)

(52) U.S. Cl.
CPC ..... *H01R 43/16* (2013.01)

(58) Field of Classification Search
CPC ..... B60R 16/0207; Y10T 29/49208; Y10T 29/53261; Y10T 29/5313; Y10T 29/53243
See application file for complete search history.

(56) References Cited

U.S. PATENT DOCUMENTS 4,190,952 A * 3/1980 Thomas ..... H01R 12/675 29/749
5,212,882 A * 5/1993 Hamonko ..... H01R 43/015 29/749
5,224,251 A * 7/1993 Cameron ..... H01R 43/052 29/33 M (Continued)

FOREIGN PATENT DOCUMENTS

EP 0386893 A2 9/1990

OTHER PUBLICATIONS

TE Connectivity: "TE Connectivity: DECAM-7 Fully-Automatic IDC Machine for Multiple and Simple Harnesses", Aug. 29, 2013 (Aug. 29, 2013), p. 1, XP054976842, Retrieved from the Internet: URL: https://www.youtube.com/watch?v=anwdpS53aQs [retrieved on Oct. 17, 2016].

*Primary Examiner* — Minh Trinh
(74) *Attorney, Agent, or Firm* — QuickPatents; Kevin Prince

(57) ABSTRACT

The invention concerns a production line consisting of an automated system for the realization of the industrial wiring of IDC connectors. A first station includes a selection guide accommodating a series of IDC connectors, and a series of pushers for shifting the series of connectors to a paired closure guide for closing the connectors of a second station. The closure guide has a series of mobile spacer partitions interposed between each of several seats, configured to release the connectors by moving said partitions as soon as the connectors are crimped onto cable wires. A third crimping station comprising a series of punches spaced apart from each other at a pre-set distance on a mobile support, which can move to pull each connector the pre-set distance until it brings an adjacent punch into position at an adjacent connector to be crimped.

14 Claims, 20 Drawing Sheets

(56) References Cited

U.S. PATENT DOCUMENTS

| | | | | |
|---|---|---|---|---|
| 5,610,454 | A * | 3/1997 | Nishikawa | B60R 16/0207 174/72 A |
| 6,844,496 | B2 * | 1/2005 | Matsuda | B60R 16/0207 174/72 A |
| 6,901,657 | B2 * | 6/2005 | Takada | H01R 43/28 174/145 |

* cited by examiner

AUTOMATED SYSTEM FOR THE REALISATION OF THE INDUSTRIAL WIRING OF IDC CONNECTORS

CROSS-REFERENCE TO RELATED APPLICATIONS

This application claims the benefit of Italian Patent Application UB2016A001115, filed on Feb. 26, 2016, and incorporated herein by reference.

STATEMENT REGARDING FEDERALLY SPONSORED RESEARCH AND DEVELOPMENT

Not Applicable.

FIELD OF THE INVENTION

The object of the present invention relates to an automated system for the industrial wiring of IDC (insulation-displacement contact) connectors.

DISCUSSION OF RELATED ART

In the field of industrial automation, home automation, building automation, future electronic car wiring, and what can be related to white goods and automotive wiring, there is a need to use paired insulated conductors that at a pre-set distance have pass-through connectors crimped on said conductors.

These wirings are characterized and defined by a header of each wire, and, at a given distance, by a series of IDC connectors (i.e. with insulation displacement of the conductor connecting them and on which they are certified).

Said IDC connectors are manufactured by various companies with different appearances, some connected to each other, others interlocked with each other, others are individual products; all according to the required characteristics. These IDC connectors have a slot on whose inner sides are spaced a series of elastically yielding terminals to be coupled to corresponding electrical terminals of generic users, and on two orthogonal sides of the slit they have, at the overlying terminals, a series of holes for the through-insertion of electrical conductors with insulation.

The conductor terminal, following forced pressure, pushed towards the underlying electrical conductor, pierces the remaining insulation making the electrical connection. Said connectors usually are arranged either with an even number of pathways (through-holes of the wires) or scaled down starting from the final header.

Said connectors have a hole for the passage of each of through-type wire and isolated from the adjacent one, and once the wire to be used is correctly positioned, they are crimped by a press which performs a crimping movement with a direction orthogonal to the underlying wire.

Precisely the difficulty of feeding and positioning the wires, as well as in carrying out the crimping at the correct relative distance between the various connectors, has, in fact, made the automation of the whole of said sequence of operations difficult and impossible.

SUMMARY OF THE INVENTION

A primary object of the present invention is to make available a device which allows you to realize a wiring of IDC connectors automatically, without any manual input.

An important object of the present invention is to make available a device which automatically realizes the aforementioned wiring with a pre-set distance between said connectors.

A further object of the present invention is to make available a wiring device that carries out the above-mentioned operations in a simple and inexpensive way.

A different object of the present invention is to make available a wiring device that is reliable.

An equally important object of the present invention is to make available a wiring device that uses fewer operations.

A useful object of the present invention is to make available a device which can easily be adapted to the wiring related to the number of connectors, the number of conductors and the connectors of the various producers.

A significant object of this invention is to make available a device which can be easily adjusted to the variation of the reciprocal distance between two successive connectors along the wiring harness.

Explanation of the Invention

The object of the present invention is defined and characterized according to the claims set out below.

The present invention is suitable for the realization of the automatic wiring of a specific structuring of IDC connectors, namely a connector 4 of the parallelepiped type, equipped with at least a pair of opposing side walls 8 equipped with a number of holes 7, corresponding to the number of terminals, for the crossing of the electrical conductors on which to make the electrical connection of the terminals (generally they are elastic terminals 6 located in a groove 5 of the connector) and on a side orthogonal to the previous sides where it is possible to act for crimping by pressing.

In particular, the automatic system for the realization of wiring with IDC connectors, the object of the invention, allows you to create a wiring of the IDC connectors in a fully automatic manner, and preferably and advantageously with connectors arranged along the wiring harness at a personalized and prearranged position, where even this operation is fully automatic.

This automation includes a series of stations which refer in a logical manner to the various sequences of the creation of the wiring.

Specifically:

1—station A for the realization of the sequence of connectors;

2—station B for feeding the conductors;

3—station C for crimping:

4—station D for the sequence of crimped connectors according to the wiring to be carried out.

The invention is essentially characterized by the presence of the first station B, second station C, and third station D, where part of the station A can be missing and carried out manually by an operator.

Station A for creating the sequence of connectors carries out the function of preparing the various connectors of each individual wiring in sequence ready to be handled by the crimping station C.

Station B for feeding the conductors has the function of supplying the conductors that create the wiring through the connectors specially provided by the crimping station C.

The crimping station C consists of an inserter that feeds, with adjustable pushers, a series of connectors within a connector closing guide; said closing guide retains said connectors neatly with the facing lateral walls and in alignment with the through-holes whose terminals have to be connected electrically, to then be traversed by the conductors that create the wiring; a conductor feeding station B supplies the conductors for the wiring from one side of the last connector that realizes the series, until the end of the opposite side of the first connector that creates the series; a press, equipped with a mobile shifting axis, and able to move above from the first to the last connector, and arranged on the first connector, pushes a first punch of station D onto the first connector to realize first the crimping between the insulation piercing electrical terminals of the first connector on the underlying electric conductors; said first punch is solidly connected to a mobile support of a series of punches already arranged spaced apart from each other at the pre-set distance between the connectors along the wiring harness; said movable support then moves the first punch that solidly holds the first crimped connector with a shift away from the adjacent connector of the series and a the same amount equal to that provided by the positioning distance between the first and the second crimped connector; in this instance the feeding station frees the conductors, which slide through all the conductors of the series, of the first crimped connector.

Iteratively the movable axis shifting the press moves the press by positioning it at the next connector to be crimped and the press pushes the relative punch above the second connector to carry out the second crimping.

The succession of crimps continues for all the connectors of the wiring harness; then finally a cutting unit cuts the electrical conductors which have been further supplied from the feeding station at a pre-set number.

The series of punches is then liberated from the coupling with the crimped connectors on the wiring harness to resume the sequence of operations, moving the first punch above the new first connector of the new series of connectors fed again by the inserter within the connector closing guide.

Said feeding station shall then supplies new conductors for the next wiring.

In particular said supply station substantially consists of 3 parts, a first part that feeds the conductors from spools on which the conductors are wound towards the connectors; a second part consisting of a first programming unit in which there is a series of tampers controlled individually for locking or releasing the conductors in a programmed manner, all mounted on an electronic board for moving it, also programmed, towards a third part also equipped with the same programming system that receives the conductors from the preceding mobile press, and that presents them at the first partition containing the connectors.

Said third supply part can also move along the axis of movement of the conductors, being able to retract to allow the initial heading and the final cut of the conductors by the knives of the cutting device, and subsequently move putting the outlet of the conductors in the vicinity of the first partition containing the connectors from the end of the wiring.

Advantageously, said feeding of the connector closing guide of a series of connectors by means of an inserter is preceded by a station for the creating a sequence of connectors.

In this station there is the preliminary preparation of the planned series of connectors in a sequence to be fed to and processed by the next station C, i.e. in an ordered sequence of connectors in the order that they will take the various connectors in the wiring during crimping onto the electrical connection wires.

Advantageously, said station for making the sequence of connectors has a connector feeding area for creating an adequate stock as capacity for the creation of more connector sequences, also with different numbers of pathways or holes. From each pile loaded in the supply zone, a loader provides for the picking up of at least a first connector for the creation of the sequence.

An optional station provides for the processing of said connectors taken to make them treatable and manageable, and within the dimensional tolerances, without protruding elements or the like, which might also arise from the picking up of a single connector from each pile.

This station is also equipped with a sequencer to create the sequence of connectors according to the proposed sequential order of the connectors in the wiring, converting a row of connectors, as taken from the feed area, into a column of the same.

In fact, in order to be properly passed to the inserter, the arrangement of the series of connectors the side walls of the connectors must be provided with holes for the crossing of the conductors that face each other.

It is quite clear that in the event the supply stack has the connectors in such a way that the pick-up of the first of them from each stack would already create such an arrangement, this requirement would already be satisfied without the need to change the row of conductors into a column of conductors.

Advantageously, this conversion from a row to a column employs a sorting guide powered by an electronic board, capable of neatly matching each connector.

Advantageously, said sorter guide has a series of individual seats for receiving a single connector in each of them, being able to maintain an orderly column sequence precisely defined.

Conveniently, each seat is spaced from the adjacent one by a separator, allowing a secure and easy processing of each connector both during the conferment and also during the pick-up.

Advantageously, said sorter guide can move from the loading phase, at the loading guide on which a cylinder operates for moving the row of connectors forward (that are paired at the header, or on the side devoid of holes for the passing through of the wiring conductors), to the picking up phase near the inserter.

Advantageously said inserter is made up of device capable of picking up said connectors from the sorter guide and conferring them in an orderly manner to the connector closing guide.

Advantageously said transfer is carried out by means of a single movement of the inserter for all the connectors.

Advantageously the inserter is equipped with multiple adjustable pushers, so it can adapt to the number of pathways of the sequence of connectors and to deliver them to the connector closing guide, which creates an alignment between the holes of the connectors for each conductor that all pass through.

Advantageously, said adjustable pushers are spaced apart at least by a distance equal to or greater than the separators of the sorter guide, each being able to individually pass through each of these seats, maintaining the guidance of the movement of each connector until it is within the connector closing guide.

Advantageously said connector closing guide has an end stop, against which a wall without through-holes of the conductors, goes to rest, for a fast and secure creation of the alignment between connectors.

Advantageously said connector closing guide has partitions preferably corresponding to the spacers of the sorter guide, which are capable of retaining securely and precisely each individual connector during the wiring.

Suitably said partitions have at the top, and at least on one side, a protruding claw that establishes and precisely limits the seat of each connector not only laterally, but also at least partially in the upper part.

Advantageously said partitions are movable, operated by a control device, in order to descend and allow the connector, to which said partitions are flanked, to slide.

DETAILED DESCRIPTION OF THE PREFERRED EMBODIMENT

Figure 1:
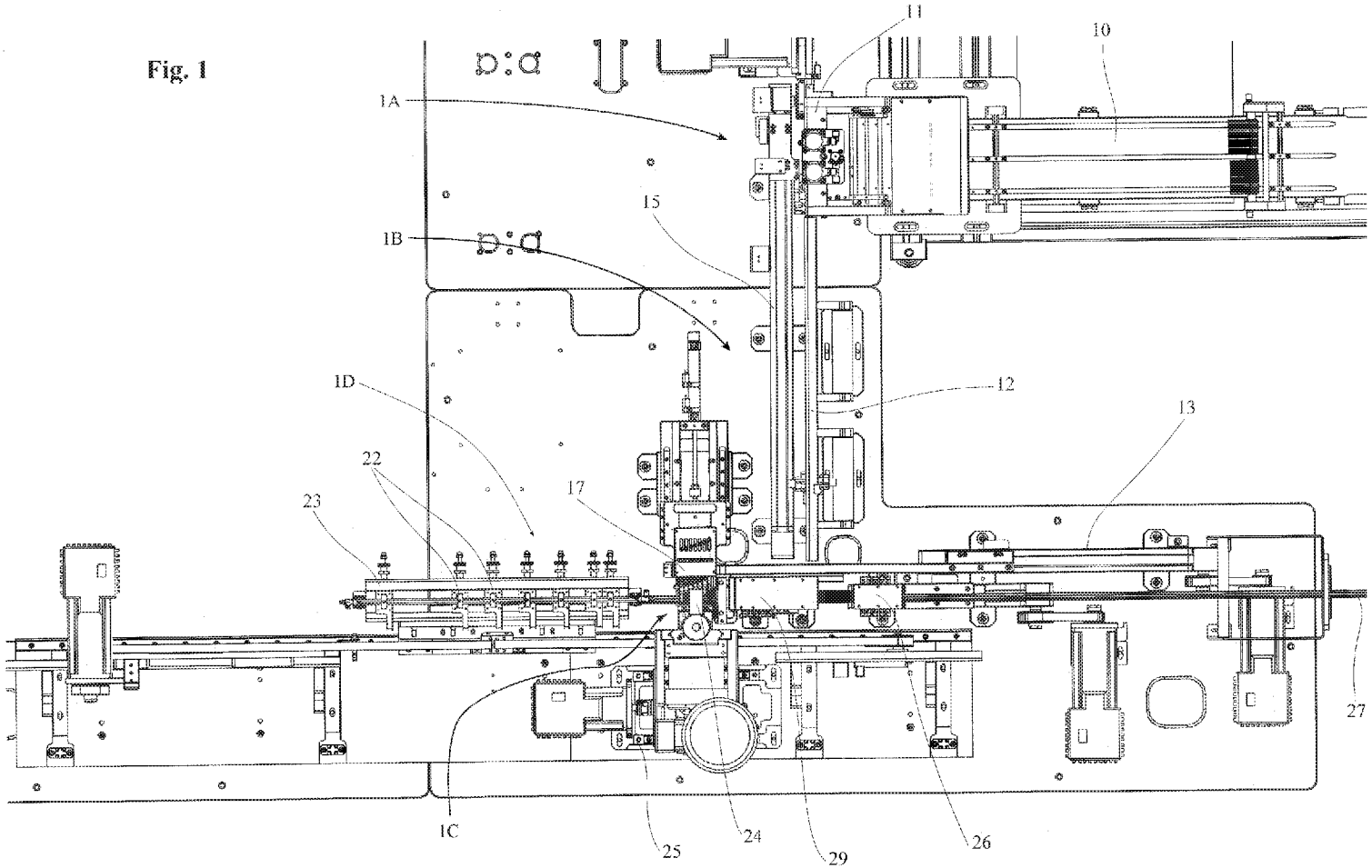
FIG. 1 shows a top plan view of the device of the invention highlighting the station for making the sequence of connectors, the station feeding the conductors, the crimping station and the station for preparing the punches with the distances fixed by the wiring.
Figure 2:
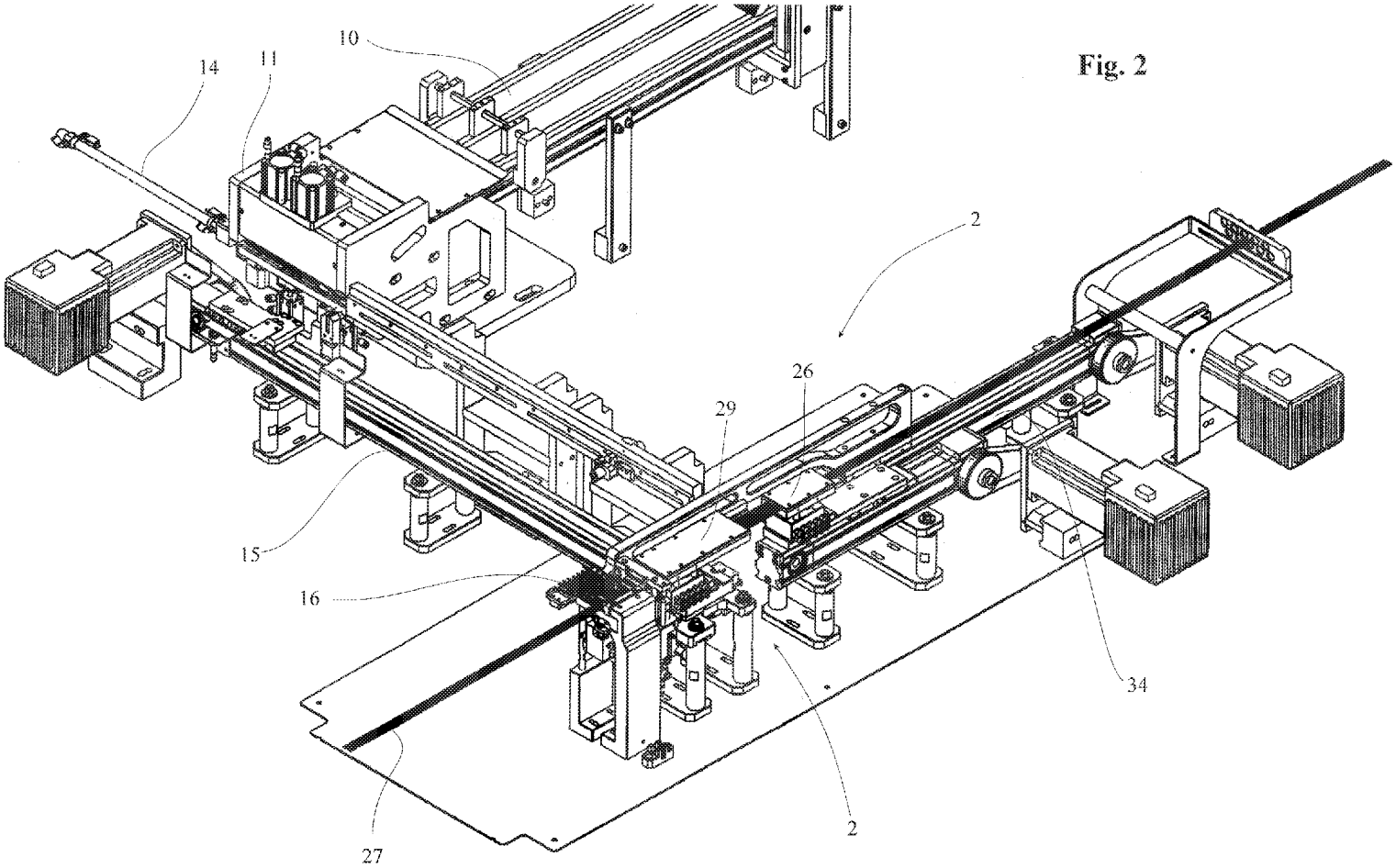
FIG. 2 shows a perspective view of some sequences from the previous figure.
Figure 3:
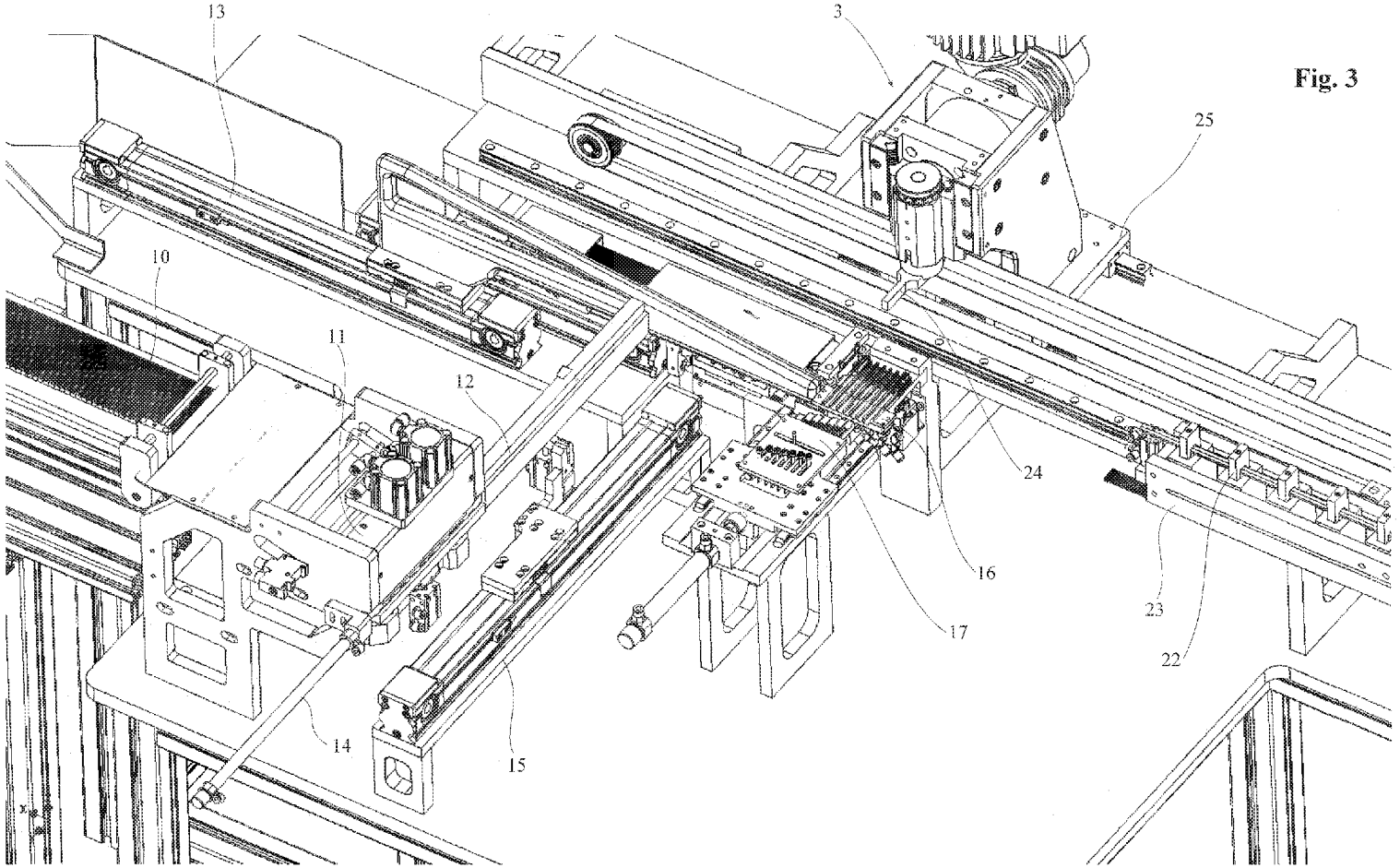
FIG. 3 shows what is set out in FIG. 2 from a different axonometric view.
Figure 4:
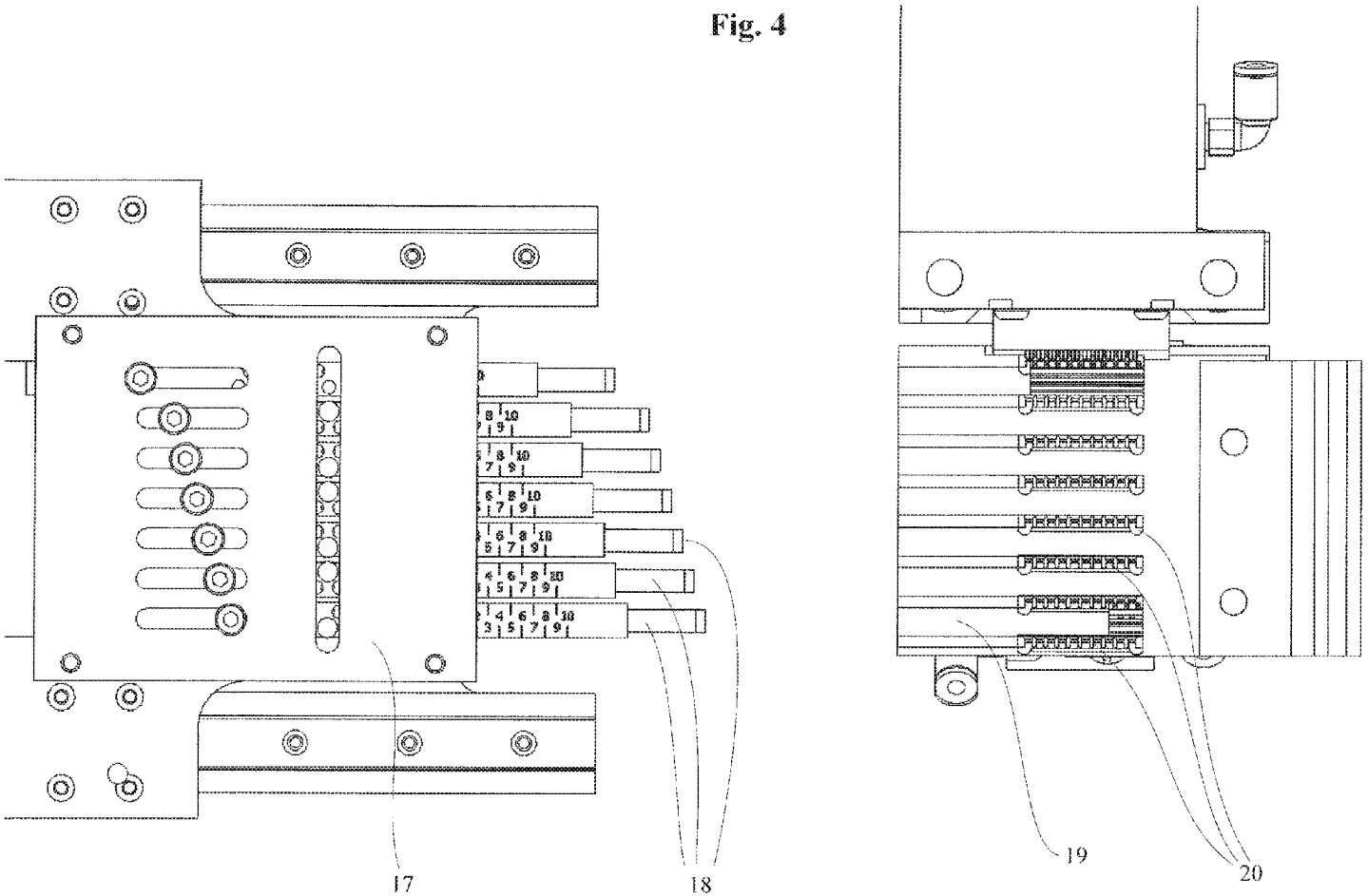
FIG. 4 shows a plan view from above of the inserter in line with the connector closing guide.
Figure 5:
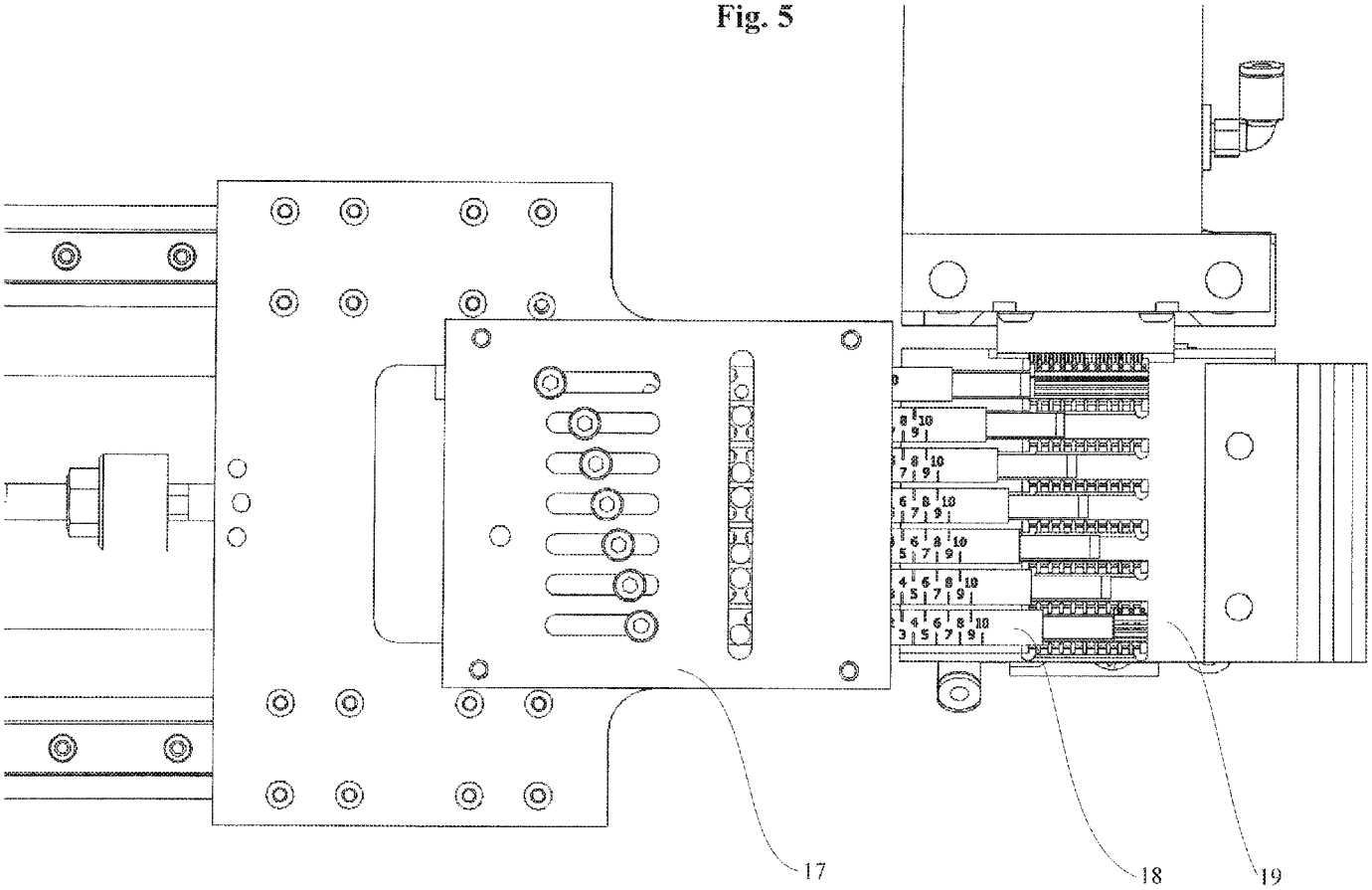
FIG. 5 shows plan view from above of the inserter during the positioning of the connector within the connector closing guide.
Figure 6:
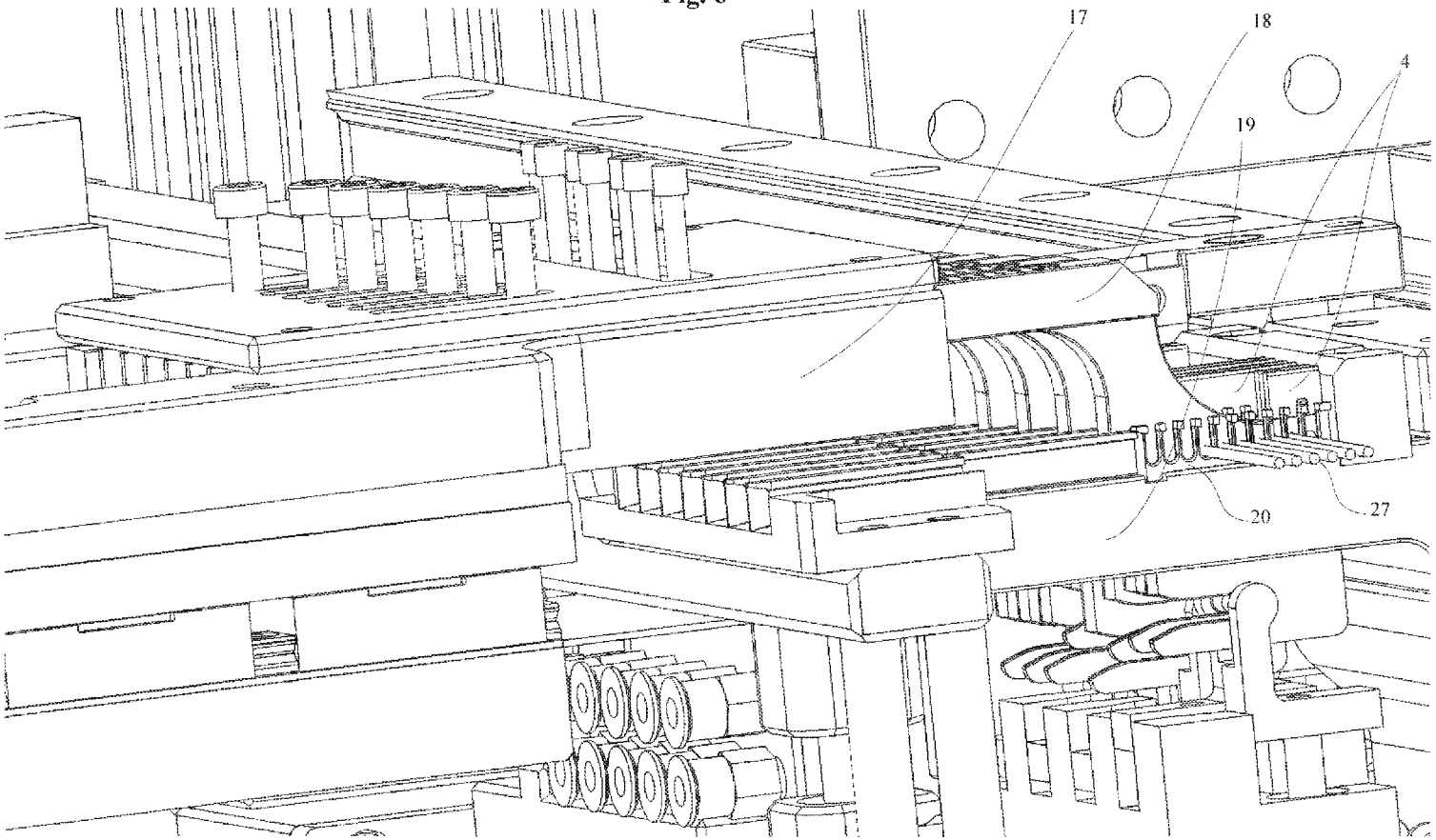
FIG. 6 shows a side-view perspective of inserters carried out so as to allow the connectors, once inserted in the guide, to return to the starting position for a new sequence.
Figure 7:
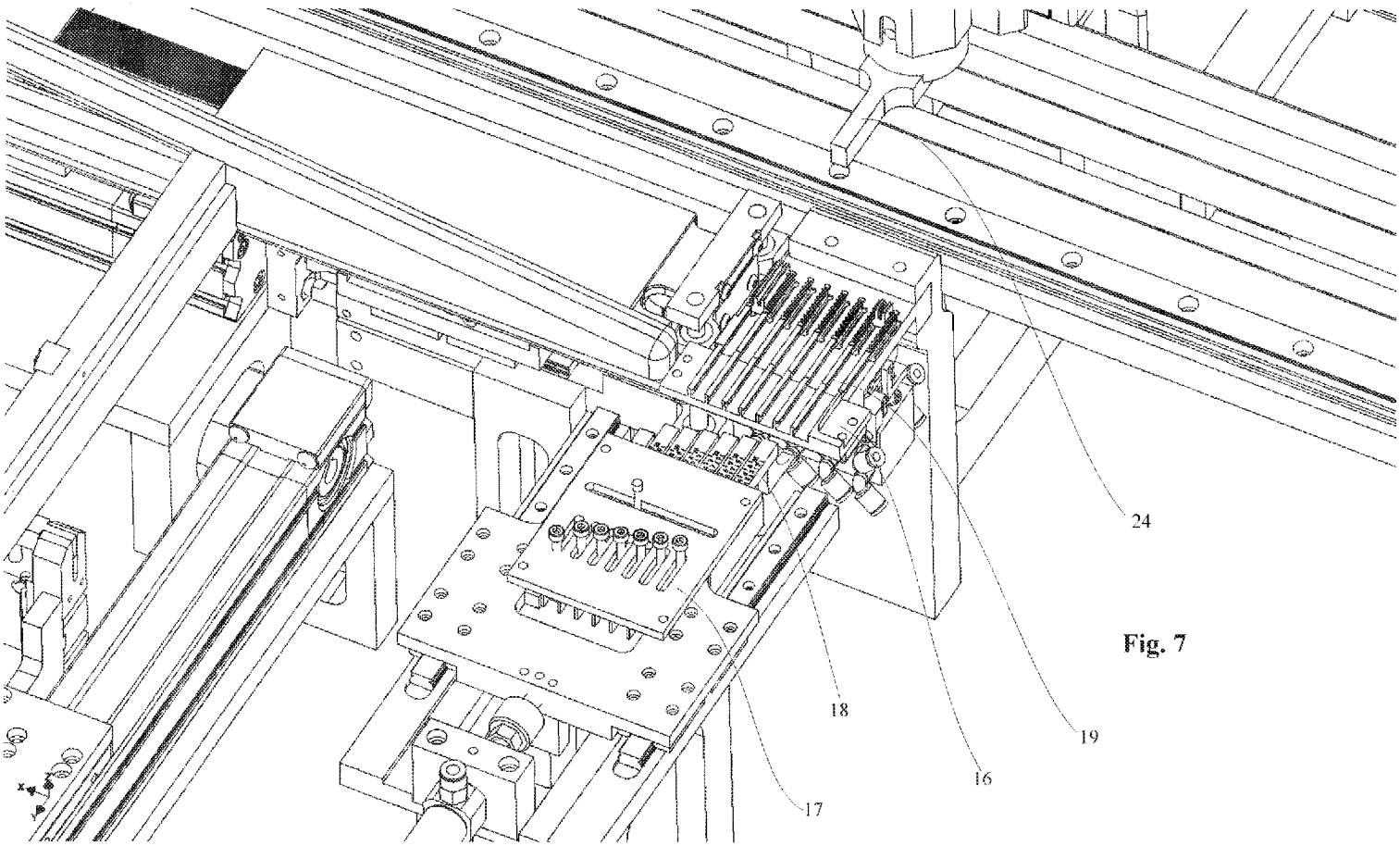
FIG. 7 shows a perspective view of the alignment between the inserter, the sorter guide and connector closing guide after some of them (for reasons of clarity only a few are shown) have already been positioned within the sorter guide.
Figure 8:
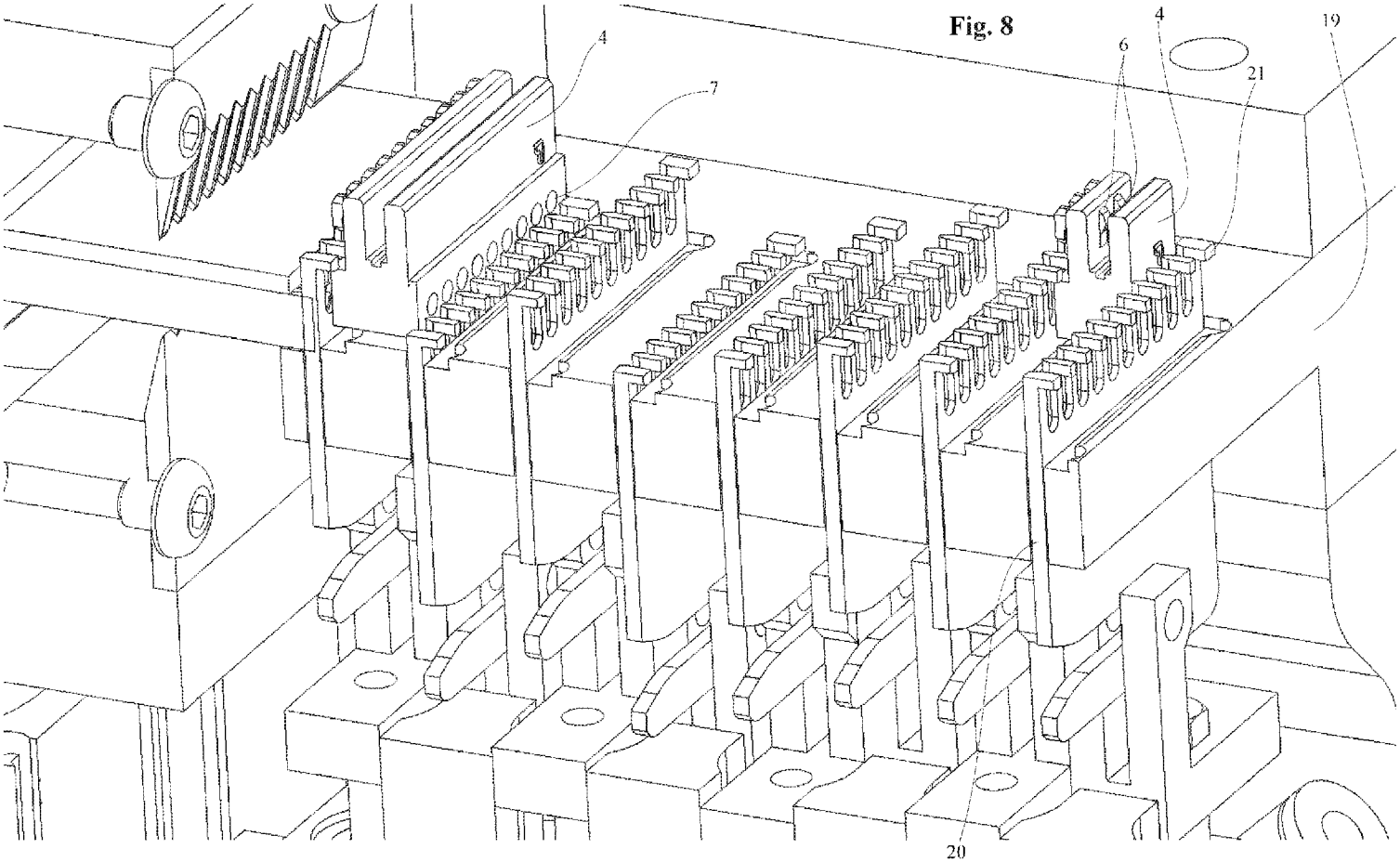
FIG. 8 shows in enlarged manner and in detail the connector closing guide on which two IDC connectors are shown by way of example.
Figure 9:
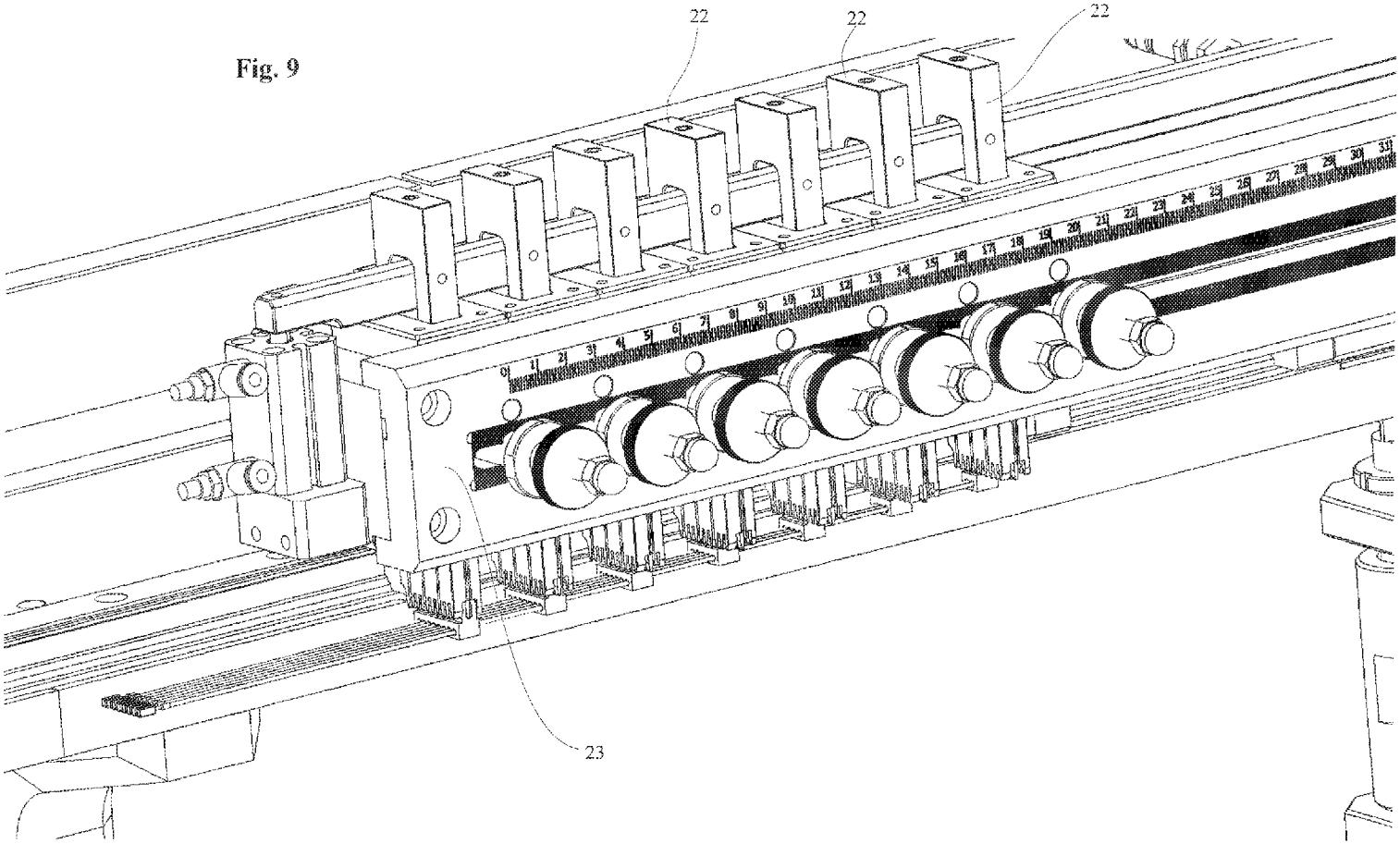
FIG. 9 shows in enlarged manner and in detail the movable support of the punches that by way of example are joined to a wiring harness.
Figure 10:
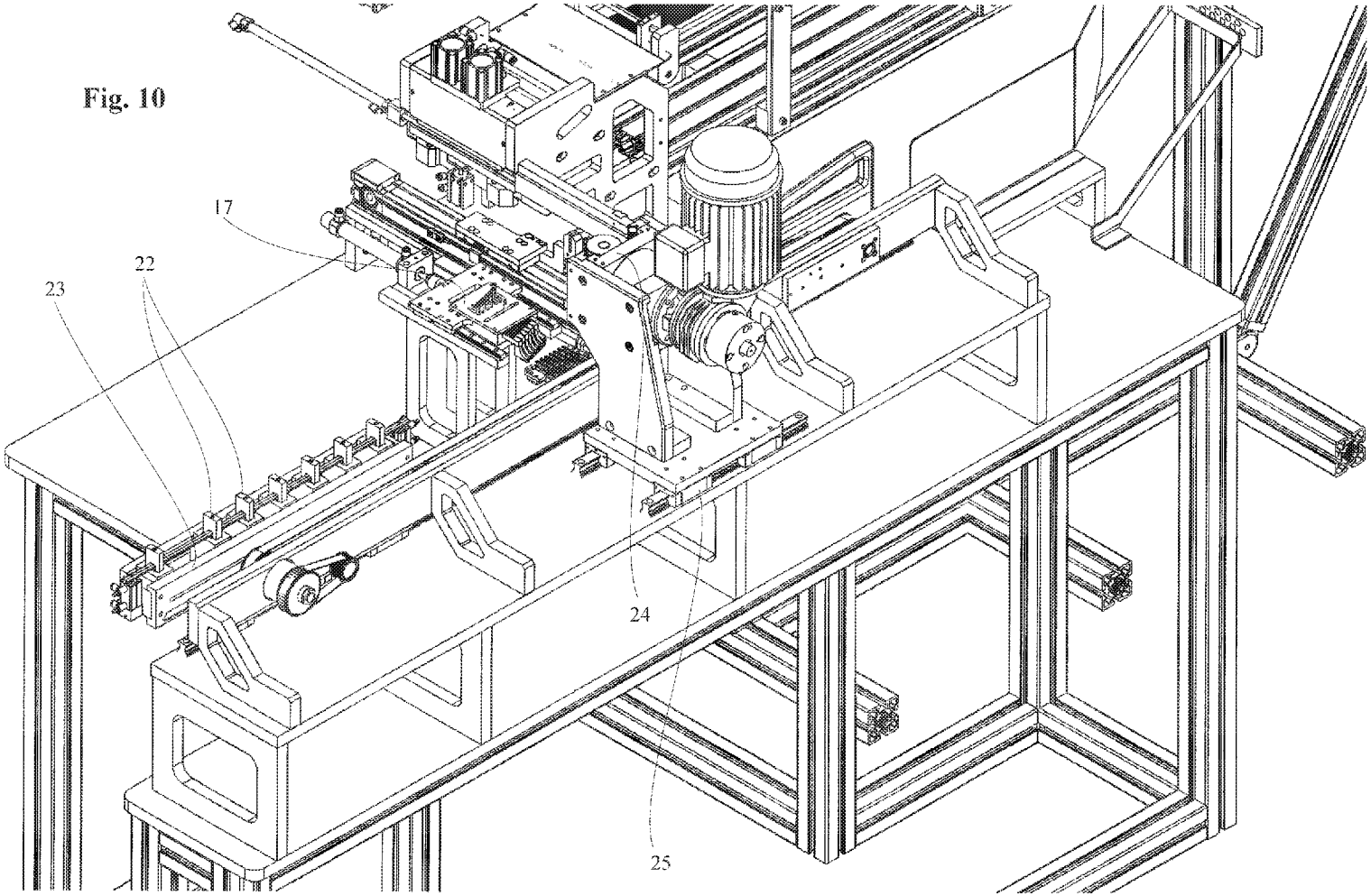
FIG. 10 shows the invention from a different perspective view.
Figure 11:
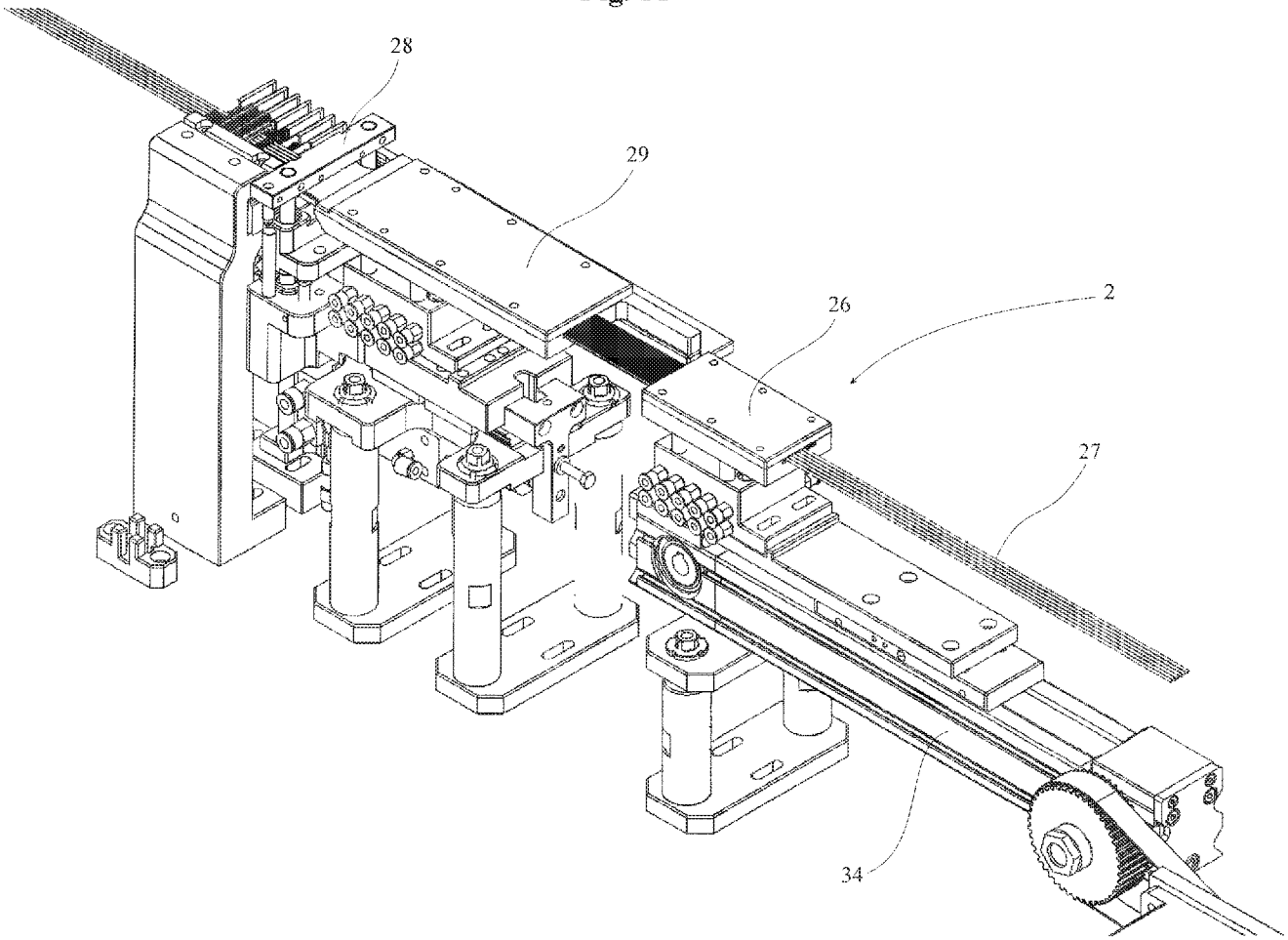
FIG. 11 shows a perspective view of the wire feed unit and the wire butting cutting unit.
Figure 12:
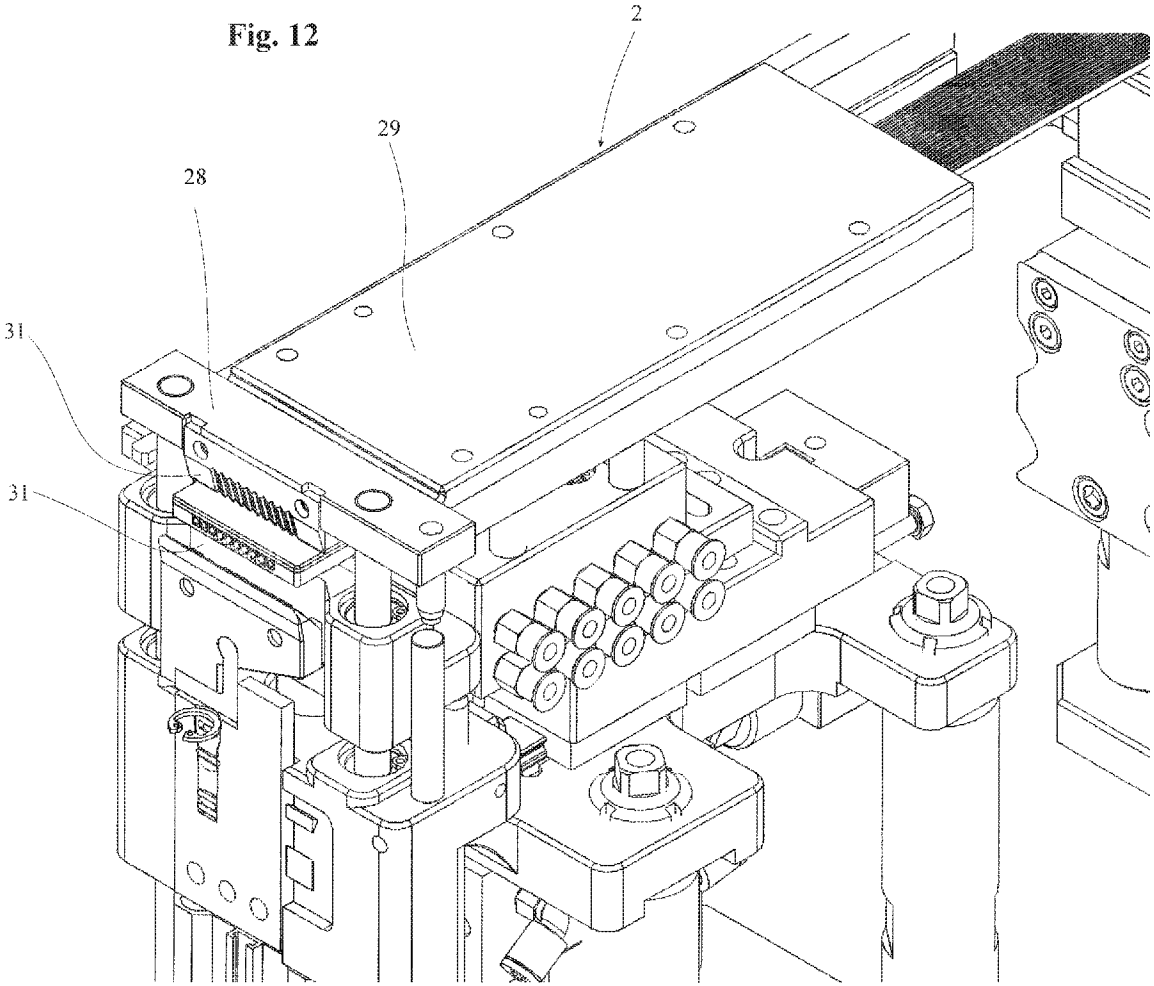
FIG. 12 shows a front perspective view of the wire and wire butting unit.
Figure 13:
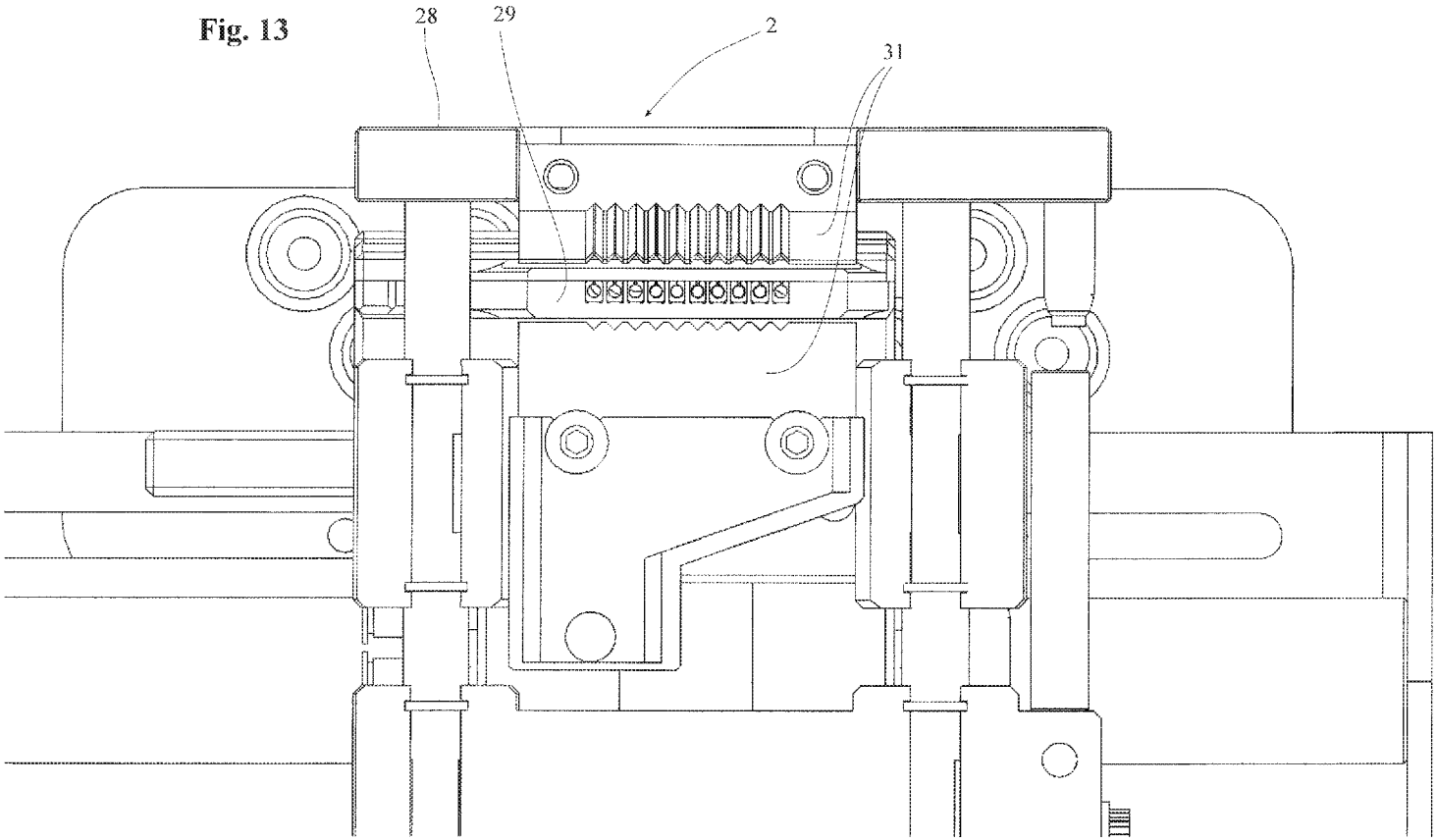
FIG. 13 shows the previous figure from a front plan view
Figure 14:
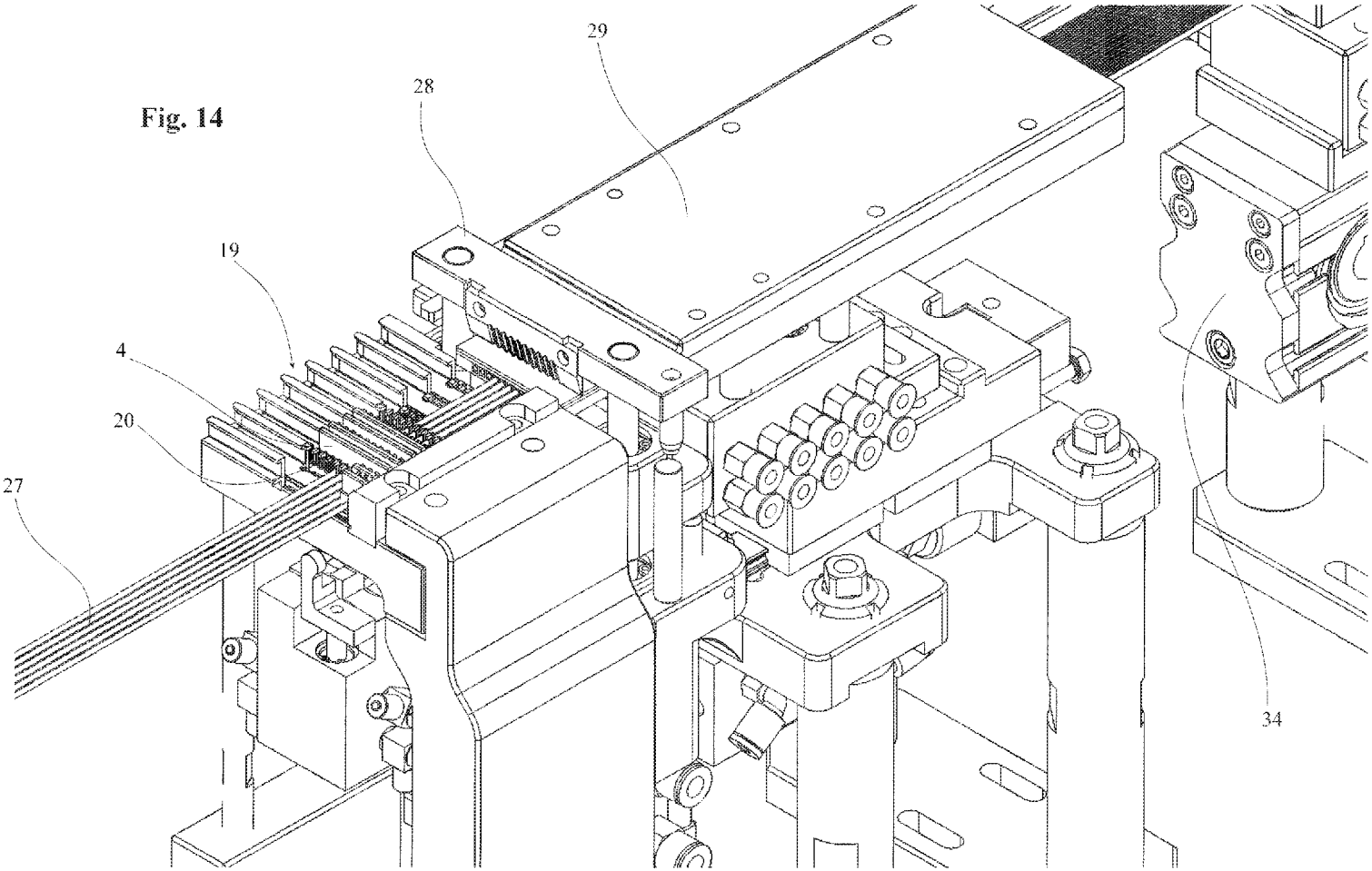
FIGS. 14, 15 and 16 show a perspective view, a front plan view and a side sectional view showing the tampers that lock and release the conductors, the connector closing guide with some connectors traversed by the relative conductors.
Figure 15:
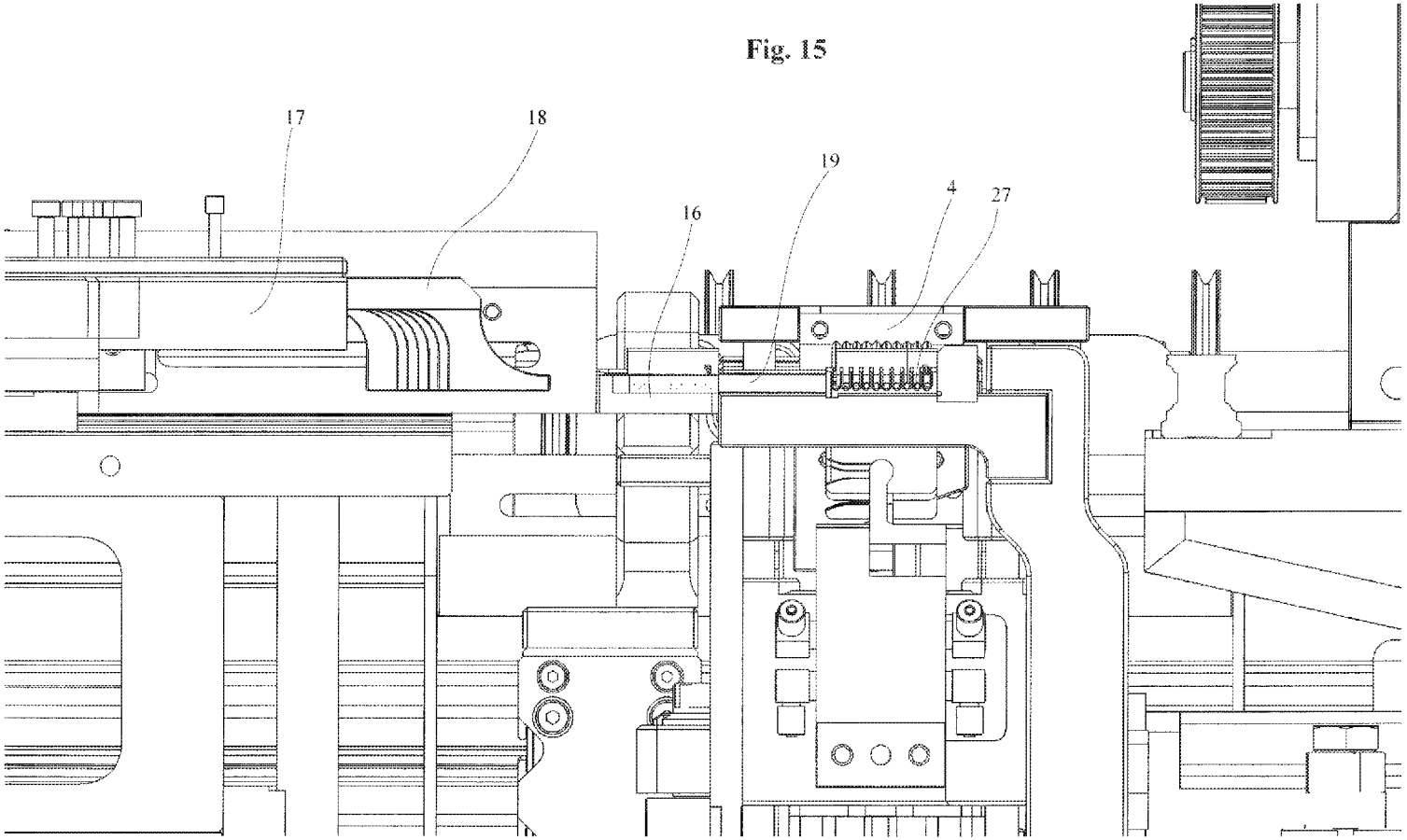
Figure 16:
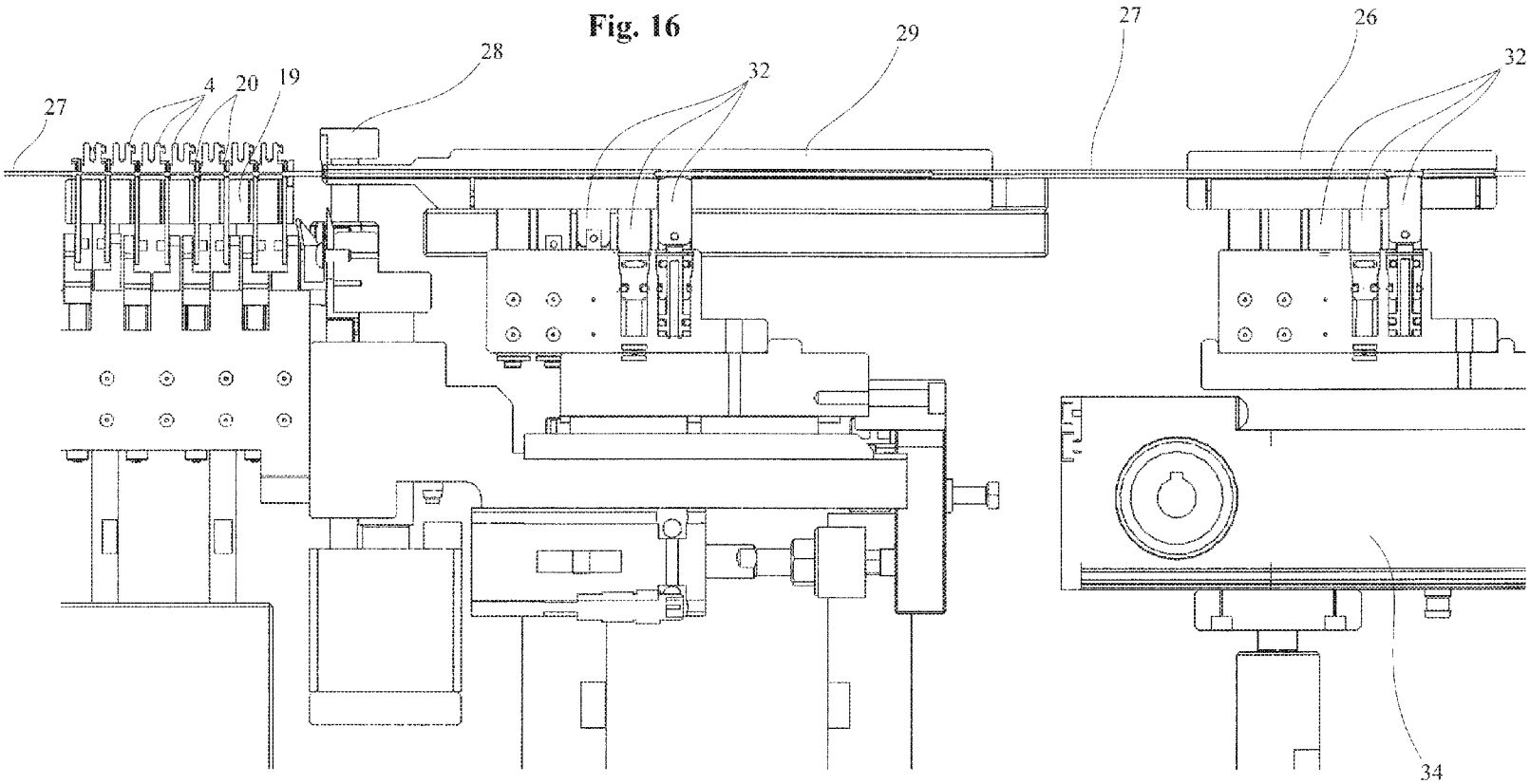
Figure 18:
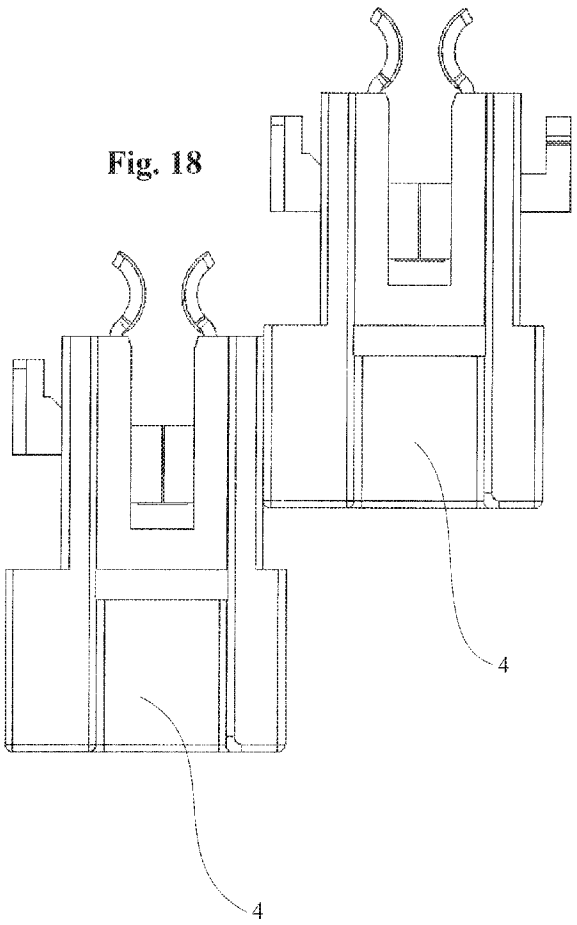
FIG. 17 and FIG. 18 show a perspective view, and a side plan view of an example of IDC connectors joined in a chain or interlocking.
Figure 17:
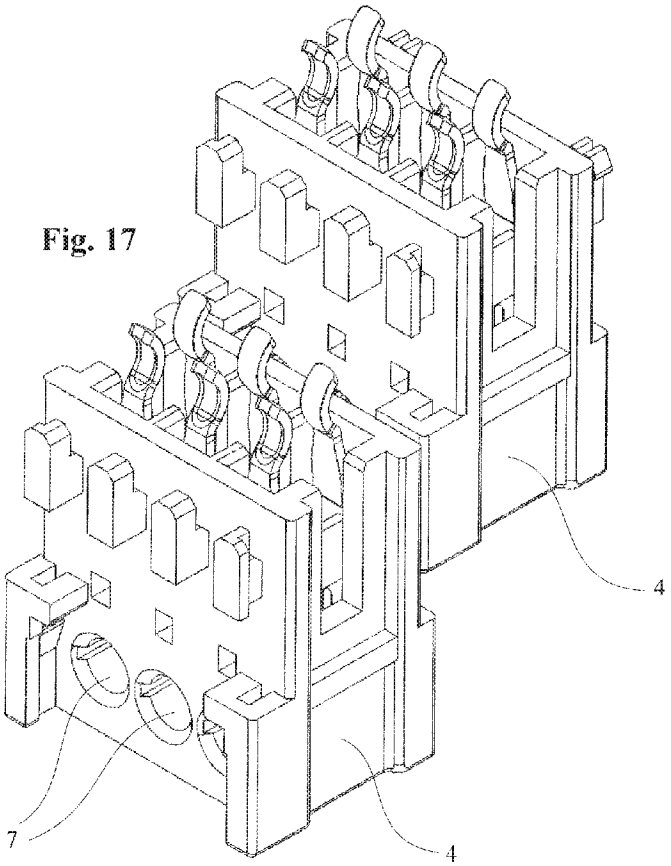
Figure 19:
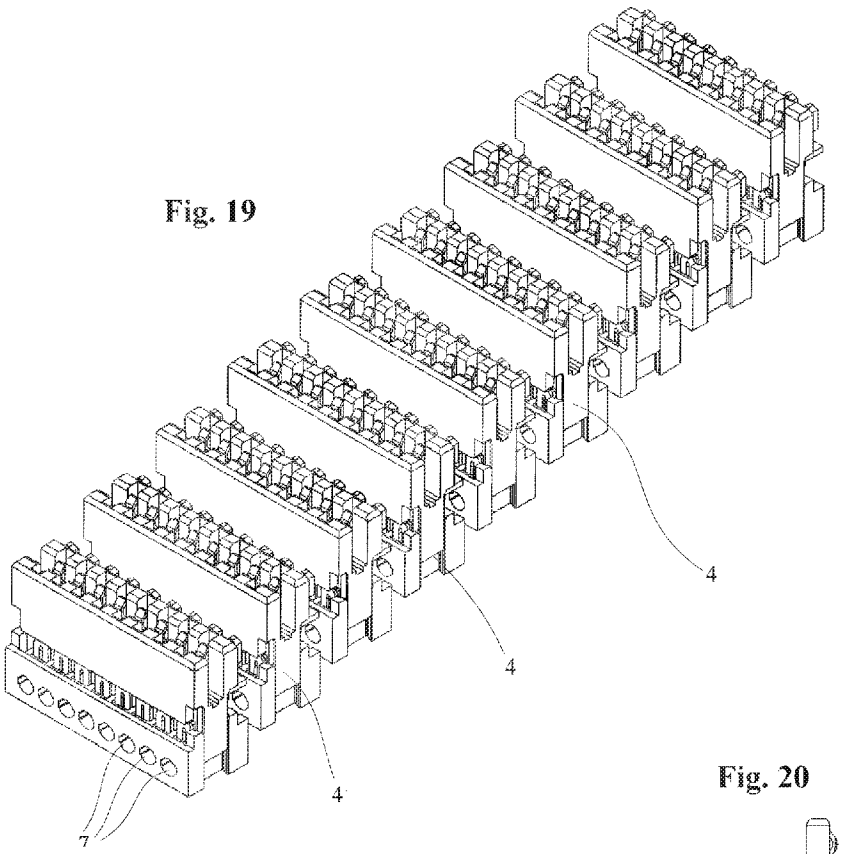
FIG. 19 and FIG. 20 show a perspective view, and a side plan view of an example of IDC connectors joined by means of tails.
Figure 20:
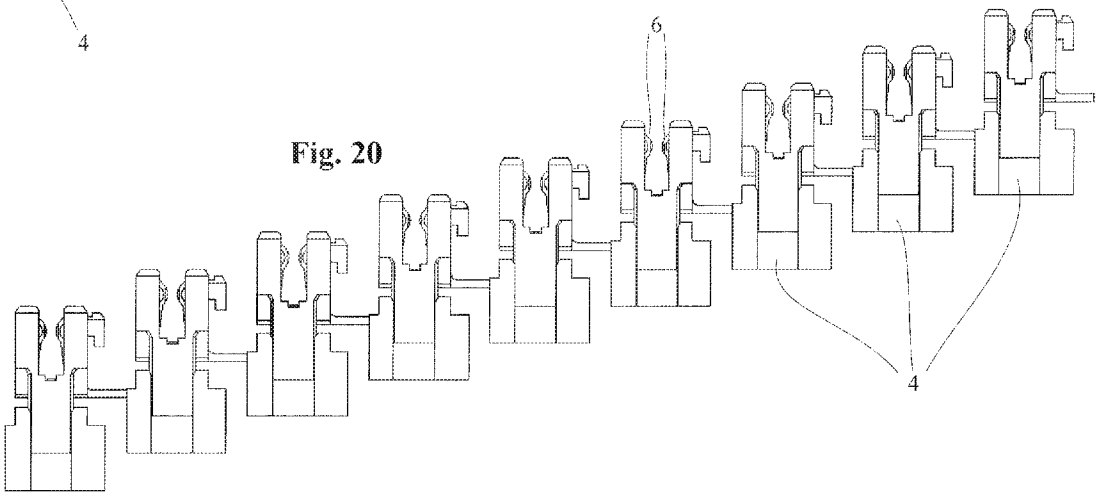
Figure 21:
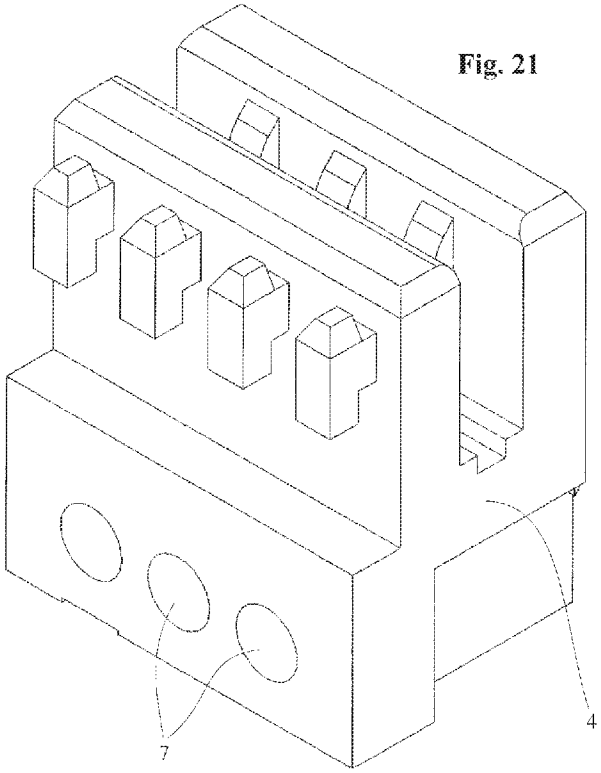
FIG. 21 and FIG. 22 show a perspective view, and a side plan view of an example of a loose or free IDC connector.
Figure 23:
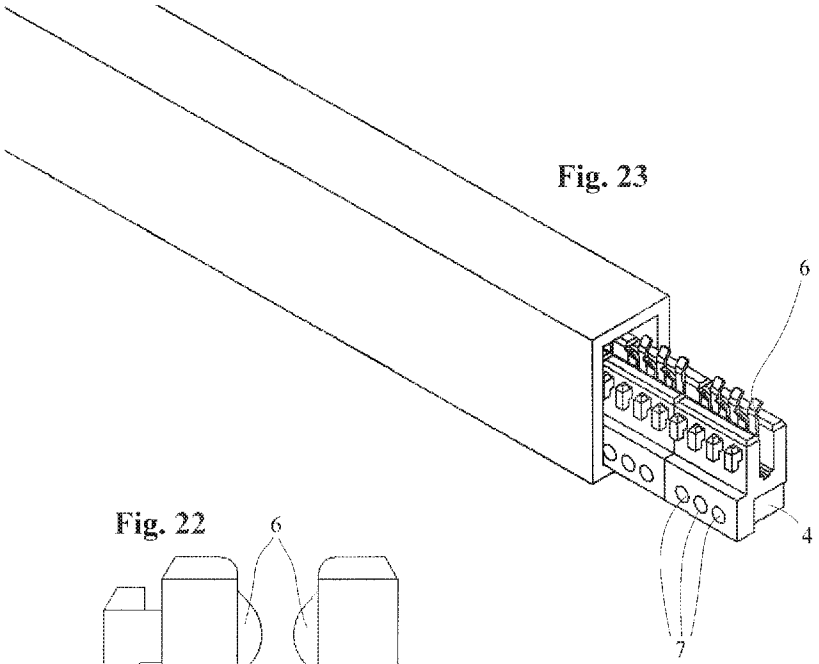
FIG. 23 shows an example of an IDC connector shown in FIGS. 21 and 22 inserted into a blister.
Figure 22:
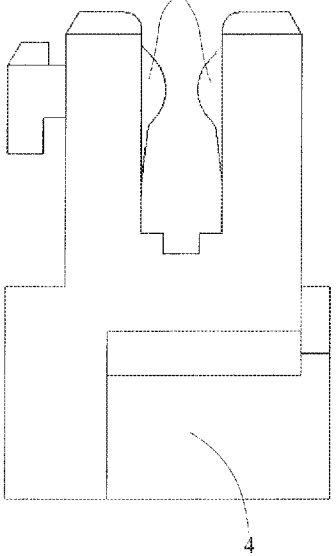
Figure 24:
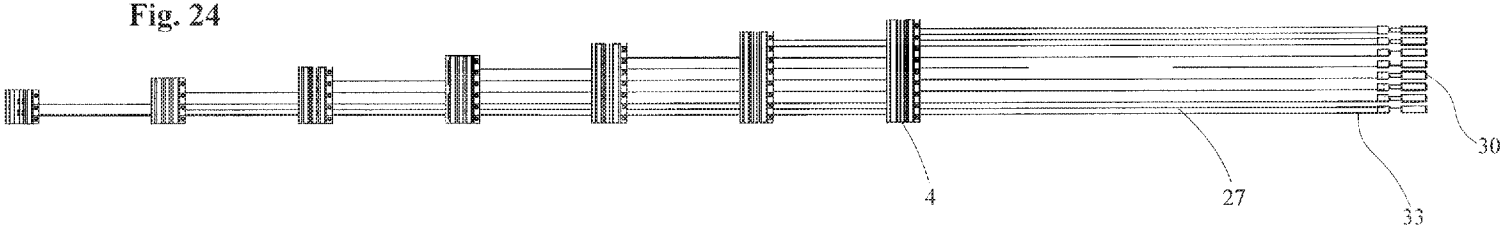
FIG. 24 shows an example of finished wiring harness achieved through the object of the invention.
Figure 25:
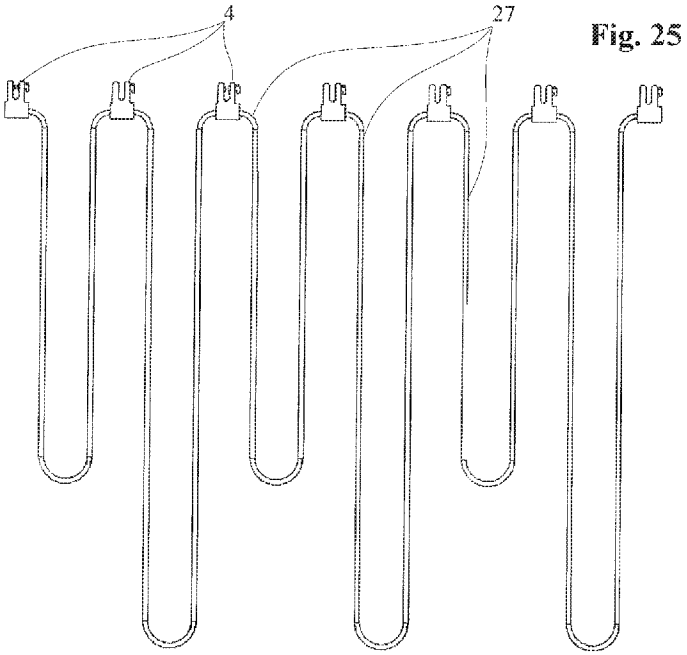
FIGS. 25 and 26 show an example of the finished wiring harness from a side view and a perspective view particularly suitable for use in the white sector, which requires a sizable length of conductor between the connectors.
Figure 26:
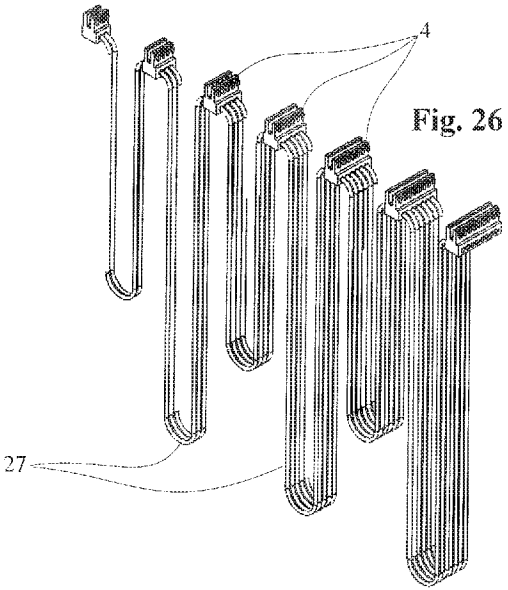

The invention is essentially characterized by the presence of the first station 1B, second station 1C, and third station 1D, where part of the station 1A can be missing and carried out manually by an operator. The connectors 4 are supplied in a column or loose by the manufacturers; each connector 4 of a generic column of connectors is joined in a close range by means of connections consisting of a series of bridges 9 joined to the adjacent connector 4, in the case of those supplied in columns.

The various columns of connectors 4 necessary for the formation of the wiring harness are inserted neatly into a loader composed of one or more feeder slides 10 according to the progression that the final wiring harness will have, the various piles going down into a slide 10 in a paired manner, or else each pile going down its own slide 10.

A separation device 11 then proceeds to pick up from the feeder slide 10 (or from the slides) the first connectors 4 of each pile creating a row of the desired sequence in accordance with the arrangement of the wiring harness.

Said row of only connectors 4 necessary for a single cabling harness rests on a lower guide 12 and are all supported at the head aligned with each other.

Each of these connectors 4 is moved within a guide 12 by a feed cylinder 14.

Subsequently said cylinder 14 retracts allowing the loading of a successive and additional sequence of connectors 4 for a successive wiring harness.

Said first sequence of connectors 4, which is arranged in succession and in a row, is transferred by means of an electronic board 15 in order into the selection guide 16 in an ordered columned sequence, preferably with the connector 4 with the lower number of pathways in the front position, and the connector with a higher number of pathways in the rear position.

This selection guide 16 is moved by means of the electronic board 13 toward a connector closing guide 19 and the entire columned sequence of the conductors 4 which create the wiring sequence are transferred by means of the inserter 17 onto said closing guide 19.

Preferably said connector closing guide 19 fits between two adjacent connectors 4 of the retention devices of each connector 4, against the movements due to the stresses of the successive operations, said retention devices may take the form of spacing partitions 20 and/or upper protruding teeth or claws 21.

Said spacer partition 20, at least for the partitions 20 between the central connectors 4 of the wiring harness, is in juxtaposition on each of its two opposite side walls with a side wall 8 of a connector 4 and at least one side may be configured at the top with an element (tooth or claw) 21 protruding at the top of a connector 4, maintaining the same connectors 4 stably and in order resting on the closing guide 19.

Said partition 20 does not interrupt the linear continuity of the opening holes 7 that the various connectors 4 have on their side walls 8, and through which the electrical conductors 27 are fed.

Said sequence of connectors 4 and partitions 20 are then ready and arranged in an orderly manner to be fed by the conductors 27 in the supply station of the conductors 2, which from the rear end of each sequence, and preferably from the side where the connector 4 is present with a greater number of connecting holes 7, are fed to reach the free front outer ends of the front connectors 4.

Said supply station for the conductors 2 is composed basically of three parts: the first part (not shown) deals with and is structured to pick up the conductors 27 from spools on which the conductors 27 are wound and to take them to a second mobile unit 26, consisting of a series of tampers 32, by means of which the conductors 27 are locked and moved using the electronic board 34 in a programmed manner toward a third unit 29, the third unit 29 which receives the conductors 27 from the previous mobile unit 26 and puts them at the first partition 20 containing the connectors.

Said third feeder unit can also move along the axis of movement of the conductors 27, being able to retract to allow the initial heading and the final cut of the conductors by the knives 31 of the cutting device 28, and subsequently move putting its conductor outlet part in the vicinity of the first partition 20 keeping the connectors 4 from the initial end of the wiring harness.

Both said second mobile unit 26 and said third unit 29 have a series of lock and release tampers 32 for each single conductor 27 of the wiring harness, so that each conductor move forward according to the requirements of the wiring.

In the event that all the connectors 4 have the same number of pathways, or holes 7, all 27 of the wires cross all the holes 7 of each connector 4 until reaching the front end of the outermost connector 4.

In the event, however, that one or more connectors 4 have a different number of pathways, the various cabling wires 27 will be fed to connect to the various connectors 4 without unconnected protruding parts.

In fact, said connectors 4 in the connector closing guide 19 are all supported on a continuous and common closing profile, so that the through-holes 7 of the connectors 4 are aligned with the various conductors.

The supply of the conductors is carried out using a feeder 26 that can insert one or more cabling wires 27 within the connectors 4.

Depending on the wiring requirements, the feeder 26 gets the conductors (cabling wires 27) to arrive at the first and front connector 4, going through the opening holes 7 of the connectors 4 of the wiring harness located between the front connector 4 front and the feeder 26 of the wires 27.

After all the wires 27 of the wiring harness have been inserted in the first connector 4 to be crimped, the overlying punch 22 is pressed by a press 24 to close and crimp the connector 4 on the wires 27 concerned.

Then the first partition 20 which kept the first connector 4 in its predetermined position on the closing guide 19 moves, leaving it free, at least on the side where there was said first partition 20, to move away from the closing guide 19.

Said first punch 22, kept in the lowered crimping position, and affecting the relative connector 4, then moves from the sequence of the connectors, bringing the crimped connector 4 from the initial position, possibly along the support guide that extends from the closure guide 19, or simply retained on said first crimping punch 22, to a second position that is exactly the distance away provided by the wiring harness between the first and second connector 4.

During the above-mentioned shifting the conductors 27 joined to the first connector 4, and inserted into the corresponding pathways of the previous connectors, slide within the relative opening holes 7, going through various connectors 4 kept fixed in their position by the various adjacent partitions 20 on the sides of each of them.

The next connector of just the conductors 27 is then supplied by the feeder 26 of the conductors 27 through the only pathways still free of the connector 4 according to the required wiring.

The second connector 4, which is still in its initial columned position between a second and third partition 20 in the closing guide 19, is then surmounted by a second punch 22 ready for crimping.

The press 24, on an electronic board 25, from the first crimping position moves to the second punch 22 to lower and carry out the second and subsequent crimping.

The sequence then starts again with the shifting and lowering of the second partition 20 to leave the second crimped connector 4, and joined with the relative punch 22, the possibility to move and slide along the support guide or remain solidly retained on the relative crimping punch 22.

The second punch 22 then, together with the second crimped connector 4, moves, pulling said second crimped connector 4, moving away from the following connector according to the distance provided by the wiring harness. In said movement the wires 27 crimped to the second connector 4 come out through the holes 7 of the previous pathways of the previous connectors.

The previous connectors 4, however, those still on the closing guide 19, although they are affected by the passage of the conductors, do not move but are retained by the retention devices, and as exemplified by the adjacent spacing and retention partitions 20.

After the complete sequence of all the punches 22 is closed on the relative connectors 4, each of which will have been moved with respect to the previous one, and therefore with it also the relative connector, by the length corresponding to the wiring requirement, a wiring harness is obtained with the number of expected conductors 27, crimped on a series of connectors 4, at the required distance automatically.

Once the final crimping is finished, the mobile support 23 of the punches 22 moves the desired length (for the terminal wires 33 that will be processed in resumption for crimping any terminal connectors 30) at this point a cutting device 28 enters into operation that cuts the conductors 27 with its knives 31 to the desired length.

The wiring harness, retained by the crimping punches 22 is moved out of the sliding guide for any additional and different processes.

The punches 22 are then brought back to the raised position disconnected from the connectors, freeing the wiring harness.

The mobile support 23 of the punches 22 then brings back the first punch 22 to a position at the first connector 4 to be crimped to resume the operating sequence.

Moving several punches can be effectively carried out in two different ways:

- the first provides that each punch 22 is mobile, equipped or otherwise with autonomous shifting devices that allow its movement to be independent of that of the adjacent punches 22;
- the second mode provides that each punch 22 is arranged on a common and mobile support 23 at a predetermined distance with respect to the adjacent punches 22 and corresponding to the pre-set distance of the connectors 4, being then subsequently all mutually forced to move with a rectilinear motion for the movement of said common support.

What is claimed is:

1. A device for the automatic wiring of a series of insulation-displacement contact (IDC) connectors, comprising:

- a first station for feeding of conductors;
- a second station for crimping;
- a third station of sequenced IDC connectors;
- the first station being comprising a selection guide which can accommodate the series of IDC connectors neatly arranged and spaced apart, and a series of adjustable pushers for shifting said series of IDC connectors from said selection guide to a paired guide for closing the IDC connectors;

the second station comprising the paired guide for closing the IDC connectors and comprising a paired set of seats capable of accommodating said series of IDC connectors from the selection guide, where said closure guide has a series of mobile spacer partitions interposed between each seat and capable of retaining the IDC connectors present in the seats and to release the IDC connectors by moving said partitions as soon as said IDC connectors are crimped onto cable wires that a programmable connector infeed has provided to feed through the various IDC connectors, said partitions movable after each crimping to free each IDC connector crimped by a corresponding overlying punch pushed by a press;

the third station comprising a series of punches spaced apart from each other at a pre-set distance on a mobile support, which can move to pull each IDC connector the pre-set distance until it brings an adjacent punch into position at an adjacent IDC connector to be crimped.

2. The device of claim 1 wherein said mobile spacer partitions leave free a space in alignment between various paths of through-holes of the IDC connectors, which are joined by each corresponding electrical connection of each conductor.

3. The device of claim 1 wherein the press has a mobile shaft positionable over each punch in succession after a pressing action of a crimping action of a previous punch, effecting electrical crimping and connection between the IDC connector and the relative conductors.

4. The device of claim 1 wherein said mobile support of the punches holds an ordered series of punches spaced apart at distances required for wiring the IDC connectors.

5. The device of claim 1 further including a station for the creation of a sequence of IDC connectors equipped with one or more feeder slides for containing a quantity of IDC connectors from which a loader picks up the first IDC connector from each slide for creating a sequence of connector heads and inserts them orderly within said selection guide in a side by side configuration, by means of an incremental shift of said selection guide at each insertion of each IDC connector by a loader.

6. The device of claim 1 wherein said adjustable pushers move said IDC connectors from the selection guide to a connector closing guide by means of a single movement.

7. The device of claim 6 wherein said shifting of the IDC connectors from the selection guide to the connector closing guide by means of said adjustable pushers makes said IDC connectors reach a precise position of reciprocal alignment with each path of a IDC connector aligned with that of the adjacent IDC connector, by means of the matching of the holes of the IDC connectors for each conductor that all must pass through.

8. The device of claim 1 wherein said adjustable pushers are spaced apart at least by a distance equal to or greater than the separators of the selection guide.

9. The device of claim 1 wherein said spacer partitions of the closing guide are parallel to the spacers of the guide sorter.

10. The device of claim 1 wherein said partitions of the closing guide are able to hold each individual IDC connector during the wiring.

11. The device of claim 1 wherein said partitions have at a top, and at least on one side, a projecting claw which precisely defines and limits the seat of each IDC connector laterally and at least partially at the top.

12. The device of claim 1 wherein said partitions are mobile, operated by a control device, so they can be lowered to allow the IDC connector to slide on flanking partitions.

13. The device of claim 1 wherein said first station for feeding the conductors comprises three parts: a first part being structured to pick up the conductors from bobbins on which the conductors are wound and take them towards the wiring; a second part consisting of a mobile press through which the conductors are pressed and moved, together with the movable press, at a programmed rate; and a third part receiving the conductors from the preceding mobile press, and which takes them to a first partition for containing the IDC connectors.

14. The device of claim 13 wherein said third part can also move along the forward axis of the conductors, being retractable to allow an initial header and a final cutting of the conductors by knives of a cutting device, and subsequently shifting and thereby positioning the third part where the conductors come out near the first partition, retaining the IDC connectors from the initial end of the wiring.

* * * * *